United States Patent [19]

Hart

[11] Patent Number: 4,672,761

[45] Date of Patent: Jun. 16, 1987

[54] SIDEHAMMER PERCUSSION ACTION

[76] Inventor: Thomas E. Hart, 505 19th St., Canon City, Colo. 81212

[21] Appl. No.: 863,739

[22] Filed: May 16, 1986

[51] Int. Cl.[4] ..... F41C 19/00

[52] U.S. Cl. ..... 42/51; 42/69.01

[58] Field of Search ..... 42/51, 83, 69.01

[56] References Cited

U.S. PATENT DOCUMENTS

| | | | |
|---|---|---|---|
| 20,757 | 6/1858 | Brey | 42/69.01 |
| 28,677 | 6/1860 | Lord | 42/83 |
| 150,349 | 4/1874 | Nudd | 42/69.01 |
| 1,226,443 | 5/1917 | Baker | 42/51 |
| 3,577,667 | 5/1971 | Kern | 42/51 |
| 4,065,867 | 1/1978 | Storey | 42/51 |
| 4,468,877 | 9/1984 | Karvonen | 42/51 |

*Primary Examiner*—Charles T. Jordan

[57] ABSTRACT

An improved action for a muzzle loading firearm utilizing a receiver with integral sidehammer easily converted from side to side and with the sidehammer having a spur pulled rearward to cock the hammer and having a positive push button bar safety.

4 Claims, 13 Drawing Figures

SIDEHAMMER PERCUSSION ACTION

REFERENCES CITED

U.S. Pat. No. 4,468,877, 9/1984, Karvonen, 42/70 F, 42/51;
U.S. Pat. No. 4,065,867, 1/1968, Storey, 42/69 R, 42/51;
U.S. Pat. No. 3,577,667, 5/1971, Kern, 42/51;
U.S. Pat. No. 1,226,443, 5/1917, Baker, 42/51;
U.S. Pat. No. 150,349, 4/1874, Nudd, 42/69 R;
U.S. Pat. No. 28,677, 6/1860, Lord, 42/83;
U.S. Pat. No. 20,757, 6/1858, Brey, 42/69 R.

SUMMARY AND BACKGROUND OF THE INVENTION

This invention relates to actions of muzzle loading percussion arms and particularly to the safety and versatility of such devices.

The present level of popularity of black powder firearms has revived interest in all forms of original actions including the side hammer type. The side hammer action has previously demonstrated superiority in faster ignition and greater safety to the shooter. The safety advantage comes from the location of the nipple directly opposite the breech area from the shooter's face which directs escaping gas completely away from the face. The main shortcomings of previous sidehammer actions are (1) that the hammer has no halfcock or safe position or the halfcock depends on a fragile notch in a hardened (sometimes brittle) steel part and (2) that an action designed for a right handed shooter is unsafe when used in a left handed position because of the location of the nipple and inherent gas escape toward the shooter's face and (3) that the sidehammer is awkward to quickly cock because the hammer spur is at the forward end of the striker or hammer nose.

The present invention overcomes the foregoing shortcomings of prior art side hammer actions in three ways: (1) By providing a positive push button bar safety which holds the hammer in a safe position slightly off the nipple and has the additional feature of being automatically returned only when the hammer is moved to full cock position; (2) By having a hammer that is changed from right side to left side simply by removing its pivot screw, changing position and installing the pivot screw. The nipple is moved to the opposite side at the same time and exchanged for a plug in the unused nipple mounting hole; (3) By having the hammer spur located for an easy rearward pull with the forefinger to set the hammer to full cock.

The action is further enhanced by the easy replacement of barrels to add to the versatility of the firearm and by having a trigger adjustable for sear engagement, weight of pull and overtravel. The foregoing and other objectives, features and advantages of the invention will be more readily understood upon consideration of the following detailed description of the invention taken in conjunction with the accompanying drawings.

DESCRIPTION OF THE PREFERRED EMBODIMENT

Figure 1:
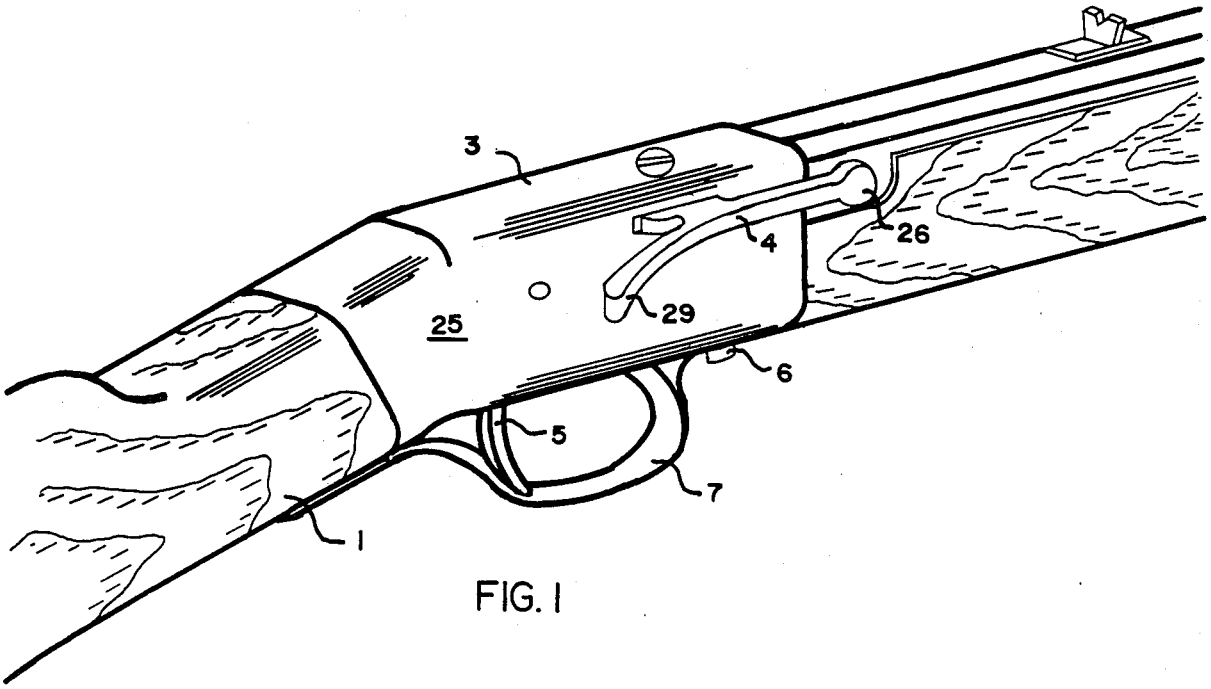
FIG. 1 is a perspective view of the improved single hammer action installed in a muzzleloader percussion firearm.

Referring more particularly to the drawings by characters of reference, FIG. 1 shows an improved action 3 embodying the invention installed in a muzzle loading percussion firearm 1. The visible parts of the action 3 as seen in FIG. 1 are its receiver 25, hammer 4, trigger 5, safety 6 and trigger guard 7. The hammer 4 is shown in its fired position or released position with its nose 26 covering and obscuring the nipple of the firearm and the spur 29 in the extended position.

Figure 2:
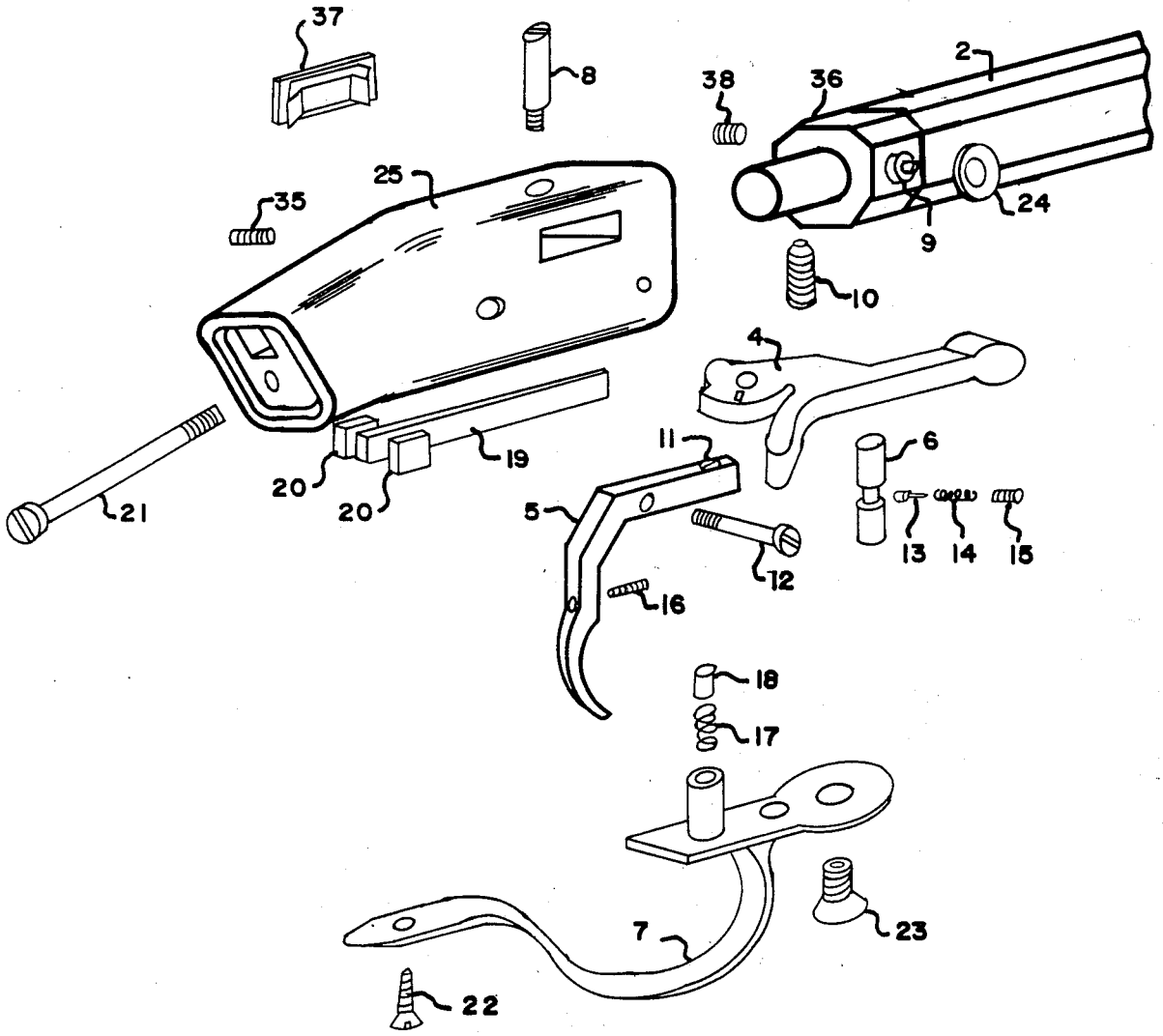
FIG. 2 is an exploded pictorial view of the action of FIG. 1.

FIG. 2 is an exploded perspective view of the action showing the total structure which comprises in addition to parts 25, 4, 5, 6 and 7 already mentioned a hammer pivot screw 8, barrel locking screw 10, sear 11, trigger pivot screw 12, safety retainer 13, retainer spring 14, retainer screw 15, trigger overtravel screw 16, trigger spring 17, spring effector 18, mainspring 19, mainspring shim 20, stock screw 21, trigger guard screws 22 and 23, flash cup 24, mainspring screw 35, breech plug 36, cover 37, and vent plug 38.

Figure 7:
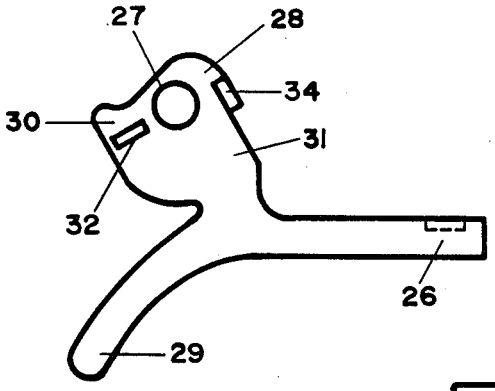
FIG. 7 is a top view of the hammer used in the action of FIG. 1.
Figure 7A:
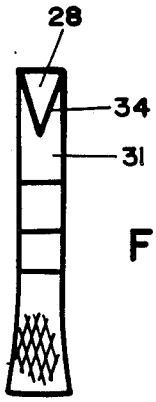
FIG. 7A is a front edge view of the hammer used in the action of FIG. 1.
Figure 7B:
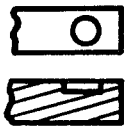
FIG. 7B is a detailed section view of the nose of the hammer used in the action of FIG. 1.

The hammer as shown in FIG. 7 has a rear projection 30 upon which the mainspring effects side pressure relative to the long axis of the receiver and causes rotational movement of the hammer around its pivotal axis hole 27. The hammer also has a front projection 28 which is wedge shaped with the point of the wedge outwardly directed from a vertical plane centered through the receiver 25 longways. The point of the wedge is centered midway in the front face of the front projection 28 making the projection symmetrical about a plane parallel to the flat bearing surfaces and centered in the hammer as shown in FIG. 7A. The sloping surface of the wedge exerts a camming action on the upper end of the safety 6. When the hammer is rotated to its cocked position, the safety 6 is forced to slide along its long axis by the sloping surface 34 until the safety 6 is in a disengaged position. The safety is held disengaged until the hammer is released from the cocked position. The hammer nose 26 is counterbored to form a recess, FIG. 7B, which is centered over the nipple of the firearm when the hammer is in its released position. The bottom of the recess contacts the nipple and thus exerts force on a percussion cap, if installed, and causes it to ignite. FIG. 7 also shows a notch 32 in the rear projection 30 which engages a sear 11 when the hammer is rotated to the cocked position. There is an identical notch on the opposite side of the hammer from 32 which makes the hammer symmetrical about a plane parallel to the flat bearing surfaces and centered in the hammer as shown in FIG. 7A. This symmetry is important because it allows the hammer to be installed in either of two positions with the spur 29 and nose 26 extending from either the right side or left side of the receiver. The action can thus be used by either a right or left handed person simply by removing the hammer pivot screw 8, changing the position of the hammer 4 and nipple 9 and installing the pivot screw again. The alternate hammer positions are shown in FIG. 3 and FIG. 4.

Figure 3:
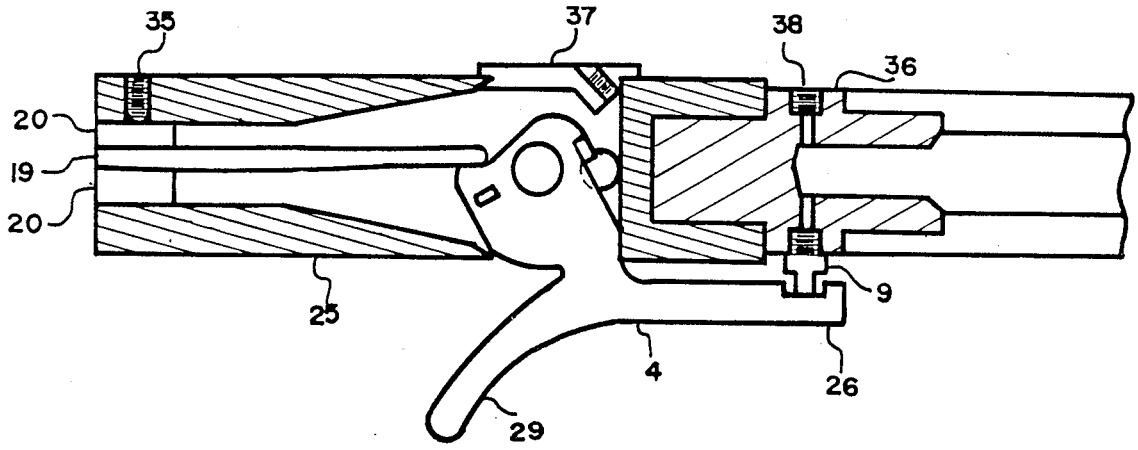
FIG. 3 is a top view of the action with the top of the receiver cut away to reveal internal parts. The hammer and nipple are portrayed in the right hand operating position.
Figure 4:
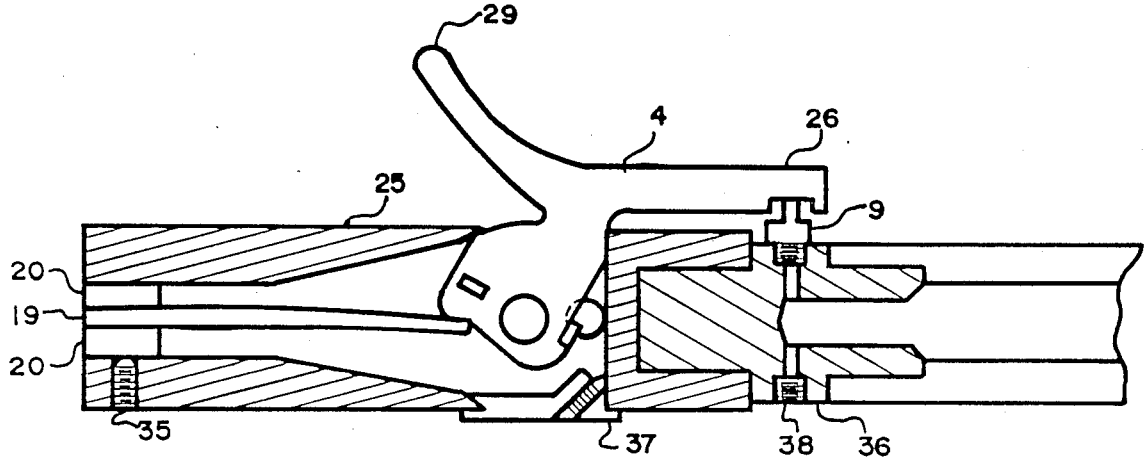
FIG. 4 is the same as FIG. 3 with the difference that the hammer and nipple are portrayed in the left hand operating position.
Figure 6:
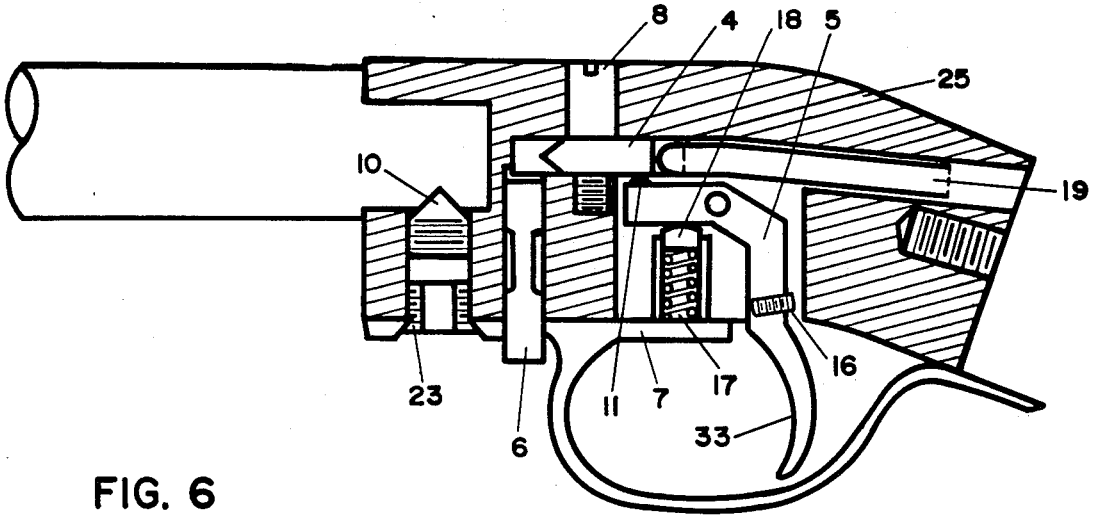
FIG. 6 is a left side view of the action of FIG. 1 with the left side cut away to reveal internal parts.
Figure 8:
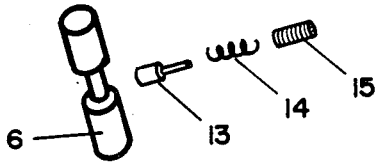
FIG. 8 is a perspective view of the bar safety and its retainer spring used in the action of FIG. 1.
Figure 11:
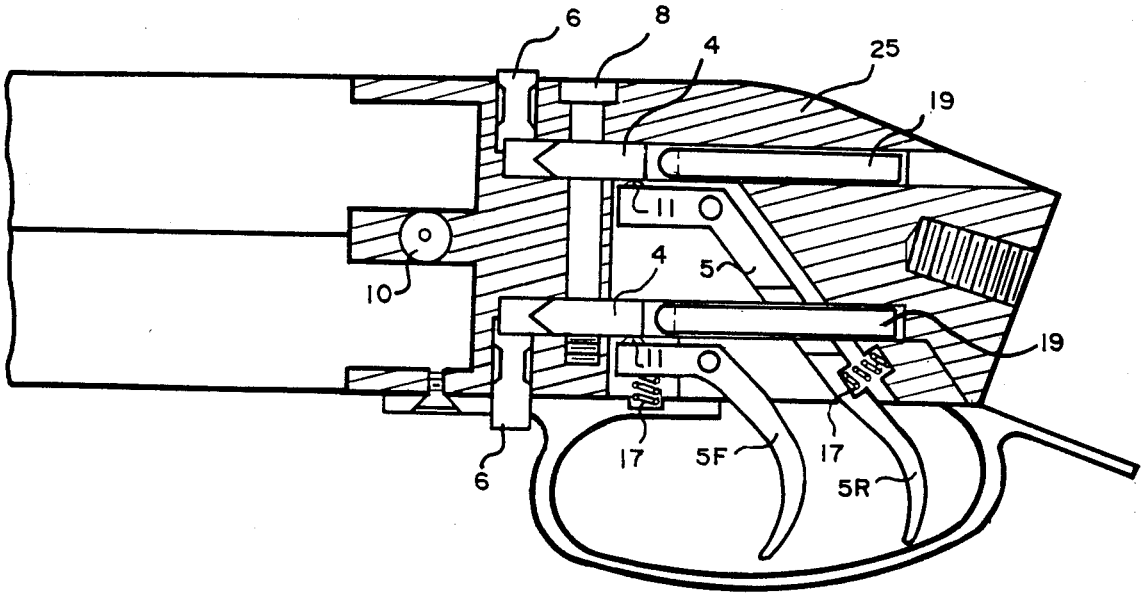
FIG. 11 is a left side view of the action of FIG. 9 with the left side cut away to reveal internal parts.

The mainspring 19 shown in FIGS. 3, 4 and 11 is held by shim blocks 20 which are clamped by screw 35 through the receiver 25 and is arranged to apply pivotal pressure to the rear projection 30 of the hammer in either installed position of the hammer. FIG. 6 shows the relation of the bar safety 6 to the hammer 4. If the hammer is rotated slightly toward its cocked position, the front face 31 (FIG. 7) of the hammer is rotated rearward allowing clearance for the bar safety 6 to be moved upward along its long axis by exerting finger pressure on the exposed bottom extension of the safety 6. If the hammer 4 is released, it is now held in a position where the hammer nose 26 (FIG. 1) cannot contact the nipple, this displacement caused by the interference of the upper end of the bar safety 6. This is the safety position of the hammer and is altered only by rotating the hammer to the cocked position. FIG. 8 shows the bar safety 6 and its spring 14 loaded retainer pin 13 and screw 15. The force exerted by the spring 14 through the retainer pin 13 prevents the safety from falling free of the hammer surface 31 in the event the hammer 4 is only slightly moved from the safety position as in the case of the hammer spur 29 being bumped or snagged accidentally.

Figure 5:
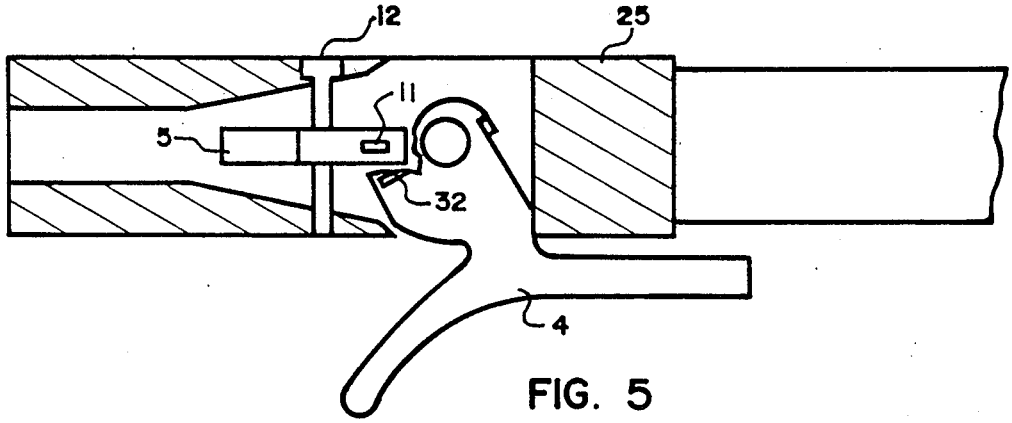
FIG. 5 is a top view of the action of FIG. 1 with the top of the receiver cut away to reveal internal parts.

FIG. 5 and FIG. 6 show the relationship of the trigger-sear to the hammer 4. As the hammer 4 is rotated to the cocked position, the notch 32 in the lower surface of the hammer is aligned with the sear 11. The pressure of the trigger spring 17 through its effector 18 causes the trigger to rotate about its pivot screw 12 and in turn causes the sear 11 to rise into the notch 32 of the hammer. The hammer is then retained in the cocked position by the interference of the sear until finger pressure is applied to the trigger shoe 33 causing the trigger to rotate in the opposite direction and pulling the sear 11 free of the notch 32, releasing the hammer to move to the fired position. Any overtravel of the trigger 5 after having released the hammer from the cocked position is prevented by adjusting the trigger stop screw 16 to contact the receiver 25 at the desired point.

Figure 9:
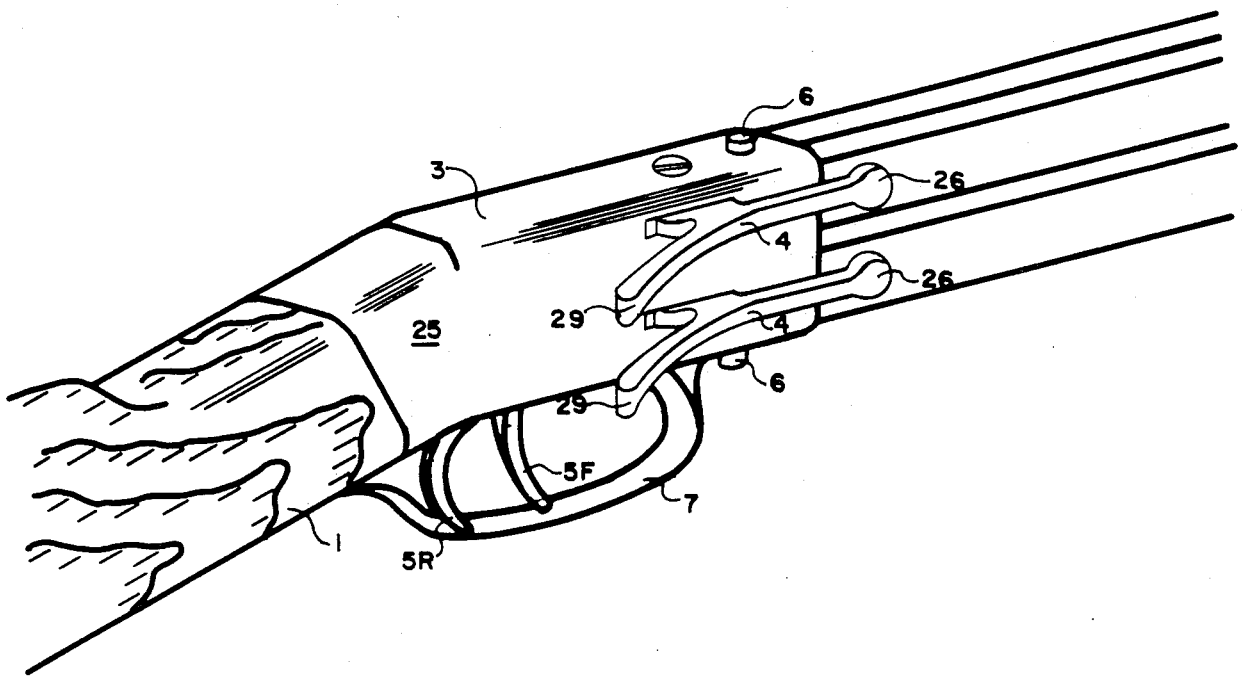
FIG. 9 is a perspective view of the improved double hammer action installed in a muzzleloader percussion firearm.
Figure 10:
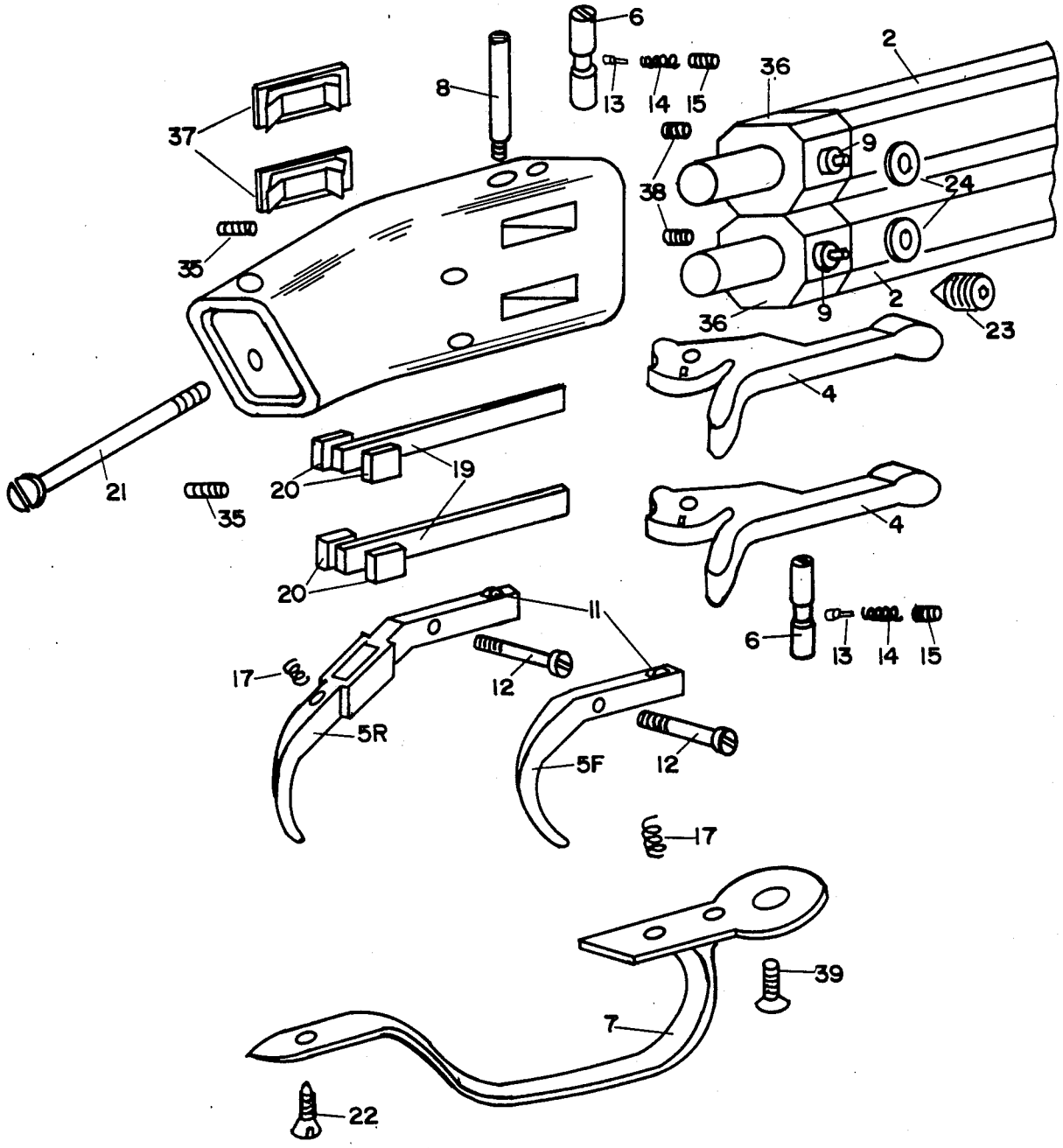
FIG. 10 is an exploded pictorial view of the action of FIG. 9.

As shown in FIGS. 9, 10 and 11, the aforementioned features can be embodied in an action to mount and fire two barrels with individual hammers, triggers and safeties for each barrel. The receiver, triggers, hammer screw and trigger guard are altered to accomodate the double configuration. All other parts interchange between the two styles.

I claim:

1. A muzzle loader firearm action comprising in combination:

a receiver having openings extending therethrough, said openings to accept a hammer, trigger-sear, and safety;

a hammer pivotally mounted within said receiver and arranged alternately to move laterally to and from either of two plane surfaces thereof, the rear projection of said hammer extending over one said opening in said receiver for engaging said trigger-sear mounted centrally in said receiver, the side projection of said hammer being provided with a nose selectively engageable with a percussion cap mounted on a nipple on the firearm and provided with a spur to enable said hammer to be moved rotationally about said pivot by pulling rearward parallel to said plane surfaces, the front projection of said hammer extending over a said opening in said receiver for engaging said safety mounted centrally in said receiver;

spring means mounted centrally within said receiver and arranged to extend between said rear projection of said hammer and a fixed point immediately interior of either said plane surface whereby a given pivotal movement of said hammer compresses said spring means;

a trigger-sear pivotally mounted centrally in a said opening of said receiver and biased into engagement with said rear projection of said hammer and lock means mounted on said trigger-sear for detachably engaging said rear projection of said hammer when said hammer is pivoted away from either of two said plane surfaces of said receiver;

whereby said trigger-sear when actuated dislodges said lock means of said trigger-sear from said rear projection of said hammer causing said spring means to rotate said rear projection of said hammer toward said plane surface causing said nose to engage the percussion cap mounted on the nipple of the firearm; and a safety means comprising a blocking means located centrally in said opening of said receiver which axially slidably engages said front projection of said hammer when said hammer is pivoted away from either of two said plane surfaces of said receiver thereby the nose of said side projection of said hammer is prevented from engaging a percussion cap mounted on a nipple on the firearm.

2. The action set forth in claim 1 wherein:

said safety means comprises a blocking means consisting of a cylindrical safety bar mounted centrally in a cylindrical cavity of said receiver immediately adjacent to the said front projection of said hammer whereby that portion of said safety bar which extends outside said receiver may be actuated thereby slidably engaging said safety bar with the said front projection which is coincidentally rotationally moved toward said plane surface of said receiver by pulling rearward said spur wherein said engagement blocks said nose of said hammer from engaging a percussion cap mounted on the nipple of the firearm; and said blocking means is disengaged by rotating said hammer wherein said front projection moves toward said plane surface and a cam surface of said front projection engages said safety bar thereby slidably disengaging said safety bar from said front projection.

3. The action set forth in claim 1 wherein:

said hammer is pivotally mounted within said receiver in either of two positions thereby allowing the said nose of said side projection to be moved away from either of two said plane surfaces and to engage a percussion cap mounted on a nipple located in either of two positions on the firearm; and said hammer also engages said spring means and said trigger sear and said safety means in either of said two positions with no alteration necessary to said spring means and said trigger sear and said safety means.

4. The action set forth in claim 1 wherein:

two hammers are pivotally mounted within said receiver each consisting of said front rear and side projections and two said spring means mounted centrally within said receiver and arranged to bias the said rear projections of said hammers and two said trigger-sears pivotally mounted centrally in said openings of said receiver and biased into engagement with said rear projections of said hammers and two said lock means mounted on said trigger sears for detachably engaging said rear projections of said hammers when said hammers are pivoted away from said plane surface of said receiver.

* * * * *